US011866911B2

(12) United States Patent
Fukuda et al.

(10) Patent No.: US 11,866,911 B2
(45) Date of Patent: Jan. 9, 2024

(54) WORK VEHICLE AND CONTROL METHOD FOR FAN OF WORK VEHICLE

(71) Applicant: Kubota Corporation, Osaka (JP)

(72) Inventors: Yuji Fukuda, Sakai (JP); Hiroaki Nakagawa, Sakai (JP); Ryota Hamamoto, Sakai (JP); Yasuhiro Nishida, Sakai (JP); Daiki Abe, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/946,047

(22) Filed: Sep. 16, 2022

(65) Prior Publication Data

US 2023/0203789 A1 Jun. 29, 2023

(30) Foreign Application Priority Data

Dec. 24, 2021 (JP) ..... 2021-210906

(51) Int. Cl.
*E02F 9/22* (2006.01)
*F01P 7/04* (2006.01)

(52) U.S. Cl.
CPC ..... *E02F 9/226* (2013.01); *F01P 7/044* (2013.01); *E02F 9/2296* (2013.01)

(58) Field of Classification Search
CPC ..... E02F 9/226; E02F 9/2296; E02F 9/2228; F01P 7/044
See application file for complete search history.

(56) References Cited

U.S. PATENT DOCUMENTS

2016/0281328 A1* 9/2016 Hino ..... B62D 55/06
2016/0305093 A1 10/2016 Fukuda et al.

FOREIGN PATENT DOCUMENTS

JP 4312681 B2 3/2006
JP 6148399 B2 6/2017

* cited by examiner

*Primary Examiner* — Jacob M Amick
*Assistant Examiner* — Charles J Brauch
(74) *Attorney, Agent, or Firm* — MORI & WARD, LLP

(57) ABSTRACT

A control method for a fan of a work vehicle includes supplying, when an engine is started, a first current to a solenoid of a variable relief valve such that the hydraulic fluid flows by a first flow rate, supplying, when a rotational speed of the engine becomes larger than a first rotational speed threshold value, a second current larger than the first current to the solenoid such that the hydraulic fluid flows by a second flow rate smaller than the first flow rate to reduce the rotational speed of the fan, and supplying, when the rotational speed of the engine becomes larger than a second rotational speed threshold value that is larger than the first rotational speed threshold value, a current to the solenoid to change the rotational speed of the fan, the current corresponding to a temperature of liquid flowing in the work vehicle.

14 Claims, 4 Drawing Sheets

WORK VEHICLE AND CONTROL METHOD FOR FAN OF WORK VEHICLE

CROSS-REFERENCE TO RELATED APPLICATIONS

The present application claims priority under 35 U. S. C. § 119 to Japanese Patent Application No. 2021-210906, filed Dec. 24, 2021. The contents of this application are incorporated herein by reference in their entirety.

FIELD OF THE INVENTION

The present invention relates to a work vehicle and a control method for a fan of a work vehicle.

DISCUSSION OF THE BACKGROUND

Japanese Patent No. 4312681 discloses a work vehicle in which a hydraulic motor for rotating an engine cooling fan at engine start is controlled so as to fix the motor rotational speed to a predetermined speed or lower until engine start is confirmed. Thus, the influence of the hydraulic motor on the engine is reduced.

SUMMARY OF THE INVENTION

According to one aspect of the present invention, a control method for a fan of a work vehicle includes: supplying, when an engine is started, a first current that has a first magnitude to a solenoid of a variable relief valve connected to an oil passage such that hydraulic fluid output from a hydraulic pump driven by the engine flows through the oil passage by a first flow rate to rotate a hydraulic motor connected to the oil passage, supplying, when a rotational speed of the engine becomes larger than a first rotational speed threshold value, a second current that has a second magnitude larger than the first magnitude to the solenoid, such that the hydraulic fluid flows through the oil passage by a second flow rate smaller than the first flow rate, to reduce a rotational speed of the fan, and supplying, when the rotational speed of the engine becomes larger than a second rotational speed threshold value that is larger than the first rotational speed threshold value, a current to the solenoid to change the rotational speed of the fan, the current corresponding to a temperature of the liquid flowing in the work vehicle.

According to another aspect of the present invention, a work vehicle includes an engine, a hydraulic pump to be driven by the engine to supply hydraulic fluid, an oil passage connected to the hydraulic pump through which the hydraulic fluid flows, a hydraulic motor provided in the oil passage to be rotated by the hydraulic fluid, a fan connected to the hydraulic motor to rotate together with the hydraulic motor, a variable relief valve connected to the oil passage, and having a solenoid, the variable relief valve being configured to control the flow rate of the hydraulic fluid flowing through the oil passage in accordance with current flowing to the solenoid, and circuitry configured to control the magnitude of the current flowing through the solenoid to control a rotational speed of the fan, the circuitry being configured to supply, when the engine is started, a first current that has a first magnitude to the solenoid such that the hydraulic fluid flows through the oil passage by a first flow rate to rotate the fan connected to the oil passage; the circuitry being configured to supply, when the rotational speed of the engine becomes larger than a first rotational speed threshold, the second current that has a second magnitude larger than the first magnitude such that the hydraulic fluid flows through the oil passage by a second flow rate smaller than the first flow rate to reduce the rotational speed of the fan, and the circuitry being configured to supply, when the rotational speed of the engine becomes larger than a second rotational speed threshold value that is larger than the first rotational speed threshold value, a current to the solenoid to change the rotational speed of the fan, the current corresponding to the temperature of the liquid flowing in the work vehicle.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings.

DESCRIPTION OF THE EMBODIMENTS

Figure 1:
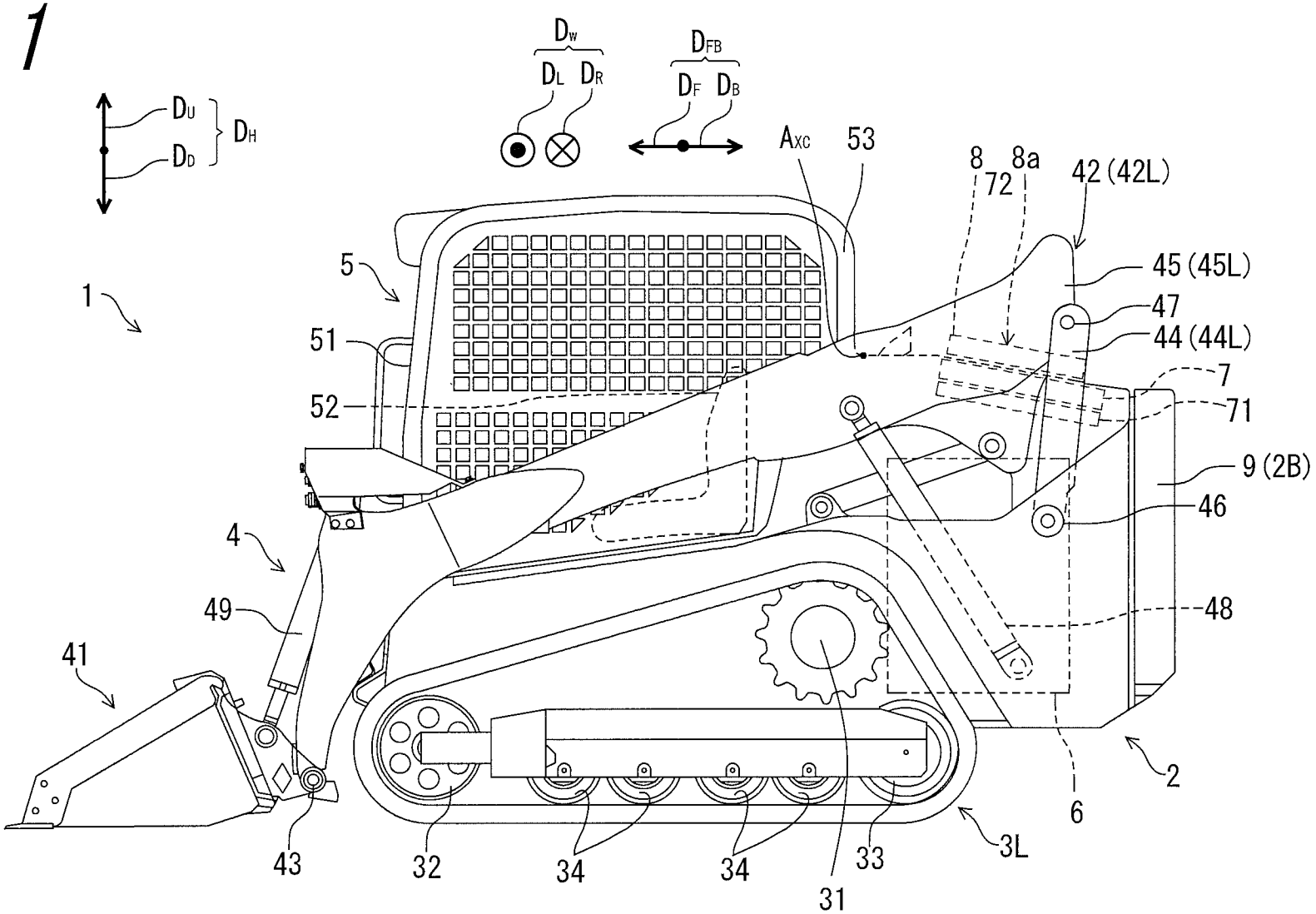
FIG. 1 is an overall side view of a work vehicle.

Embodiments of the present invention will be described below with reference to the accompanying drawings. Similar reference numerals indicate corresponding or identical configurations in the drawings.

Figure 2:
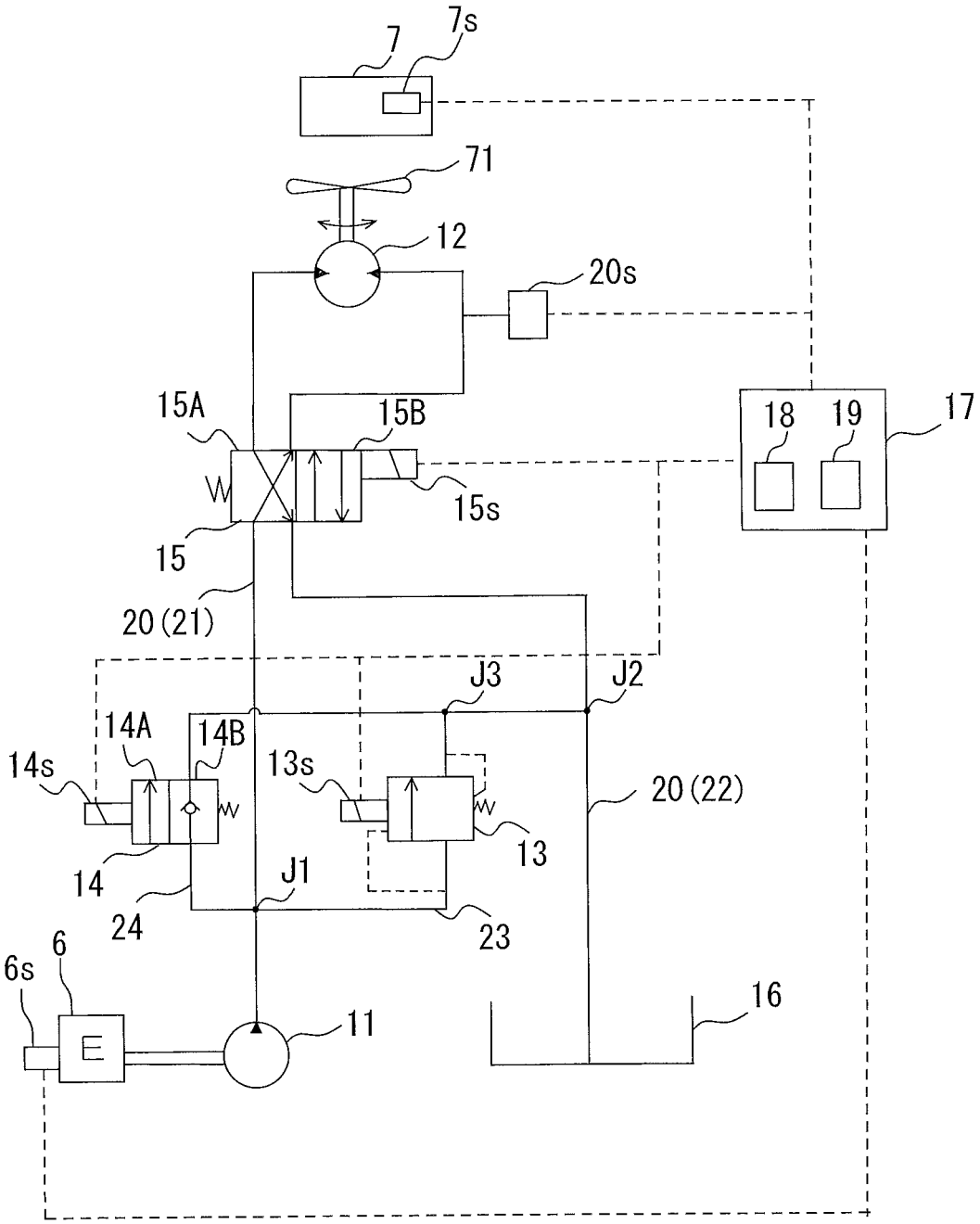
FIG. 2 is a schematic configuration diagram showing a hydraulic circuit of a work vehicle.

Referring to FIG. 1, a work vehicle 1, for example, a compact truck loader, includes a vehicle body frame 2, a traveling device 3, a work device 4, and a cabin 5. The vehicle body frame 2 supports the traveling device 3, the work device 4, and the cabin 5. In the illustrated embodiment, the traveling device 3 is a crawler type traveling device. Therefore, the traveling device 3 includes the drive wheels 31, the driven wheels 32 and 33, and the rolling wheels 34, respectively. However, the traveling device 3 is not limited to the crawler type traveling device. The traveling device 3 may be, for example, a front wheel/rear wheel traveling device 3, or a traveling device 3 having a front wheel and a rear crawler. As shown in FIG. 2, the traveling device 3 is provided on the vehicle body frame 2. The work device 4 includes work equipment (bucket) 41 at the distal end of work device 4. A proximal end of the work device 4 is attached to a rear portion of the vehicle body frame 2. The work device 4 includes a pair of arms 42 for rotatably supporting the bucket 41 via the bucket pivot shaft 43. Each of the pair of arms 42 includes a lift link 44 and a boom 45.

The lift link 44 is rotatable relative to the vehicle body frame 2 about a fulcrum shaft 46. The boom 45 is rotatable about a joint shaft 47 with respect to the lift link 44. The work device 4 further includes a plurality of boom cylinders 48 and at least one work equipment cylinder 49. Each of the plurality of boom cylinders 48 is rotatably connected to the vehicle body frame 2 and the boom 45, and moves the lift link 44 and the boom 45 to move up and down the bucket 41. At least one work instrument cylinder 49 is configured to tilt the bucket 41. The cabin 5 is attached to a front portion of the vehicle body frame 2. A work vehicle 1 includes a front door 51 in front of a cabin 5, and a driver's seat 52 and an operation device (described later) are provided in the cabin 5. An internal space of the cabin 5 is defined by a cab frame 53.

Referring to FIG. 1, the work vehicle 1 further includes an engine 6 and a heat exchanger 7 provided at a rear portion of the vehicle body frame 2. The engine 6 is configured to provide driving force to the traveling device 3 and the work device 4. The heat exchanger 7 includes a radiator for cooling a refrigerant of the engine 6. Further, preferably, the heat exchanger 7 includes an oil cooler configured to cool hydraulic fluid used in the hydraulic system of the work vehicle 1 (e.g., boom cylinder 48 and at least one work instrument cylinder 49). The work vehicle 1 includes a fan 71 for air-cooling the heat exchanger 7. The fan 71 is provided below the heat exchanger 7. The engine 6 and the heat exchanger 7 are provided between a pair of arms 42. The work vehicle 1 further includes a bonnet cover 9 provided at the rear end of the vehicle body frame 2. The bonnet cover 9 can be opened and closed so that a maintenance worker can perform maintenance work on the engine 6 and the like. The work vehicle 1 further includes a cover 8 for covering the heat exchanger 7 and the engine 6. The cover 8 is provided with an air suction port 8*a* for taking in the cooling air generated by the fan 71.

FIG. 2 is a schematic configuration diagram showing the hydraulic circuit 10 of the work vehicle 1. Referring to FIG. 2, the hydraulic circuit 10 includes an engine 6, a hydraulic pump 11, an oil passage 20, a hydraulic motor 12, a fan 71, a variable relief valve 13, an unload valve 14, a rotation direction switching valve 15, a hydraulic fluid tank 16, and a controller 17. The hydraulic pump 11 is driven by an engine 6. In other words, the rotary element of the hydraulic pump 11 is rotated by the driving force of the engine 6 to discharge the hydraulic fluid. Therefore, when the engine 6 is started, the rotating element of the hydraulic pump 11 is also rotated to discharge the hydraulic fluid.

The oil passage 20 connects the hydraulic pump 11 and the hydraulic fluid tank 16 via the hydraulic motor 12. A hydraulic circuit 10 is provided with a first bypass oil passage 23 and a second bypass oil passage 24 which branch off from an oil passage 20 at a branch point J1 and join with the oil passage 20 at a merging point J2. For convenience of explanation, the oil passage 20 between the branch point J1 and the hydraulic motor 12 is referred to as a first partial oil passage 21. That is, the first bypass oil passage 23 and the second bypass oil passage 24 are connected in parallel to the oil passage 20 (the first partial oil passage 21). Although the first bypass oil passage 23 and the second bypass oil passage 24 are merged at the merging point J3, and the first bypass oil passage 23 and the second bypass oil passage 24 are formed by one oil passage from the merging point J3 to the merging point J2, the present invention is not limited to this configuration. The first bypass oil passage 23 and the second bypass oil passage 24 need not join together until they join the oil passage 20, and the branch point between the oil passage 20 and the first bypass oil passage 23 and the branch point between the oil passage 20 and the second bypass oil passage 24 need not be a common branch point J1. When the branch point between the oil passage 20 and the first bypass oil passage 23 and the branch point between the oil passage 20 and the second bypass oil passage 24 are not a common branch point J1, the starting point of the first partial oil passage 21 is a branch point close to the hydraulic motor 12 among the branch point between the oil passage 20 and the first bypass oil passage 23 and the branch point between the oil passage 20 and the second bypass oil passage 24. When the merging point of the oil passage 20 and the first bypass oil passage 23 and the merging point of the oil passage 20 and the second bypass oil passage 24 are not a common merging point J3, the end point of the first partial oil passage 21 is a merging point close to the hydraulic motor 12 among the merging point of the oil passage 20 and the first bypass oil passage 23 and the merging point of the oil passage 20 and the second bypass oil passage 24. The second bypass oil passage 24 may be referred to as an additional oil passage.

The hydraulic motor 12 is provided in the oil passage 20 and is configured to rotate by hydraulic fluid supplied by the hydraulic pump 11. The fan 71 is connected to the hydraulic motor 12 and is provided so as to rotate with the rotational shaft of the hydraulic motor 12. The variable relief valve 13 is connected to the oil passage 20. More specifically, the variable relief valve 13 is provided in the first bypass oil passage 23. The variable relief valve 13 includes a solenoid 13*s*, and is configured to control the flow rate of hydraulic fluid flowing through an oil passage 20 (first partial oil passage 21) in accordance with the current flowing through the solenoid 13*s*. In other words, the variable relief valve 13 is configured to control the flow rate of the hydraulic fluid flowing through the hydraulic motor 12 in accordance with the current flowing through the solenoid 13*s*. As the current flowing through the solenoid 13*s* increases, the variable relief valve 13 is configured to increase the flow rate of the hydraulic fluid passing through the first bypass oil passage 23. Therefore, as the current flowing through the solenoid 13*s* increases, the variable relief valve 13 is configured so that the flow rate of the hydraulic fluid flowing through the first partial oil passage 21 decreases.

The unload valve 14 is provided on the second bypass oil passage 24 in parallel with the variable relief valve 13. The unload valve 14 has an additional solenoid 14*s*, and is configured to control the flow rate of the hydraulic fluid flowing through the second bypass oil passage 24 in accordance with the current flowing through the additional solenoid 14*s*. Specifically, the unload valve 14 can be switched between the first position 14A and the second position 14B. The unload valve 14 is configured such that when the additional solenoid 14*s* is switched to the first position 14A by applying a current exceeding the unload current S, the unload valve 14 flows a larger volume of hydraulic fluid than the variable relief valve 13. At this time, the unload valve 14 allows all of the hydraulic fluid from the hydraulic pump 11 to flow to the merging point J2 via the second bypass oil passage 24, thereby eliminating the load of the hydraulic fluid on the hydraulic motor 12. When a current not exceeding the unload current threshold is applied to the additional solenoid 14*s*, the unload valve 14 is switched to the second position 14B, and t is configured such that the hydraulic fluid is not flowed from the branch point J1 to the merging point J3 in the second bypass oil passage 24.

A rotation direction switching valve 15 can be switched between a positive rotation position 15A and a reverse rotation position 15B by operation of the switching valve solenoid 15*s*. When the rotation direction switching valve 15 is switched to the positive rotation position 15A shown in FIG. 2, the hydraulic fluid discharged from the hydraulic pump 11 flows in the positive direction in the hydraulic motor 12, and the hydraulic motor 12 rotates in the positive direction. On the other hand, when it is switched to the reverse rotation position 15B, the hydraulic fluid flows in the hydraulic motor 12 in the reverse direction, and the hydraulic motor 12 rotates in the negative direction.

The controller 17 is connected to a rotational speed sensor 6*s* for detecting the rotational speed of the engine 6, and is configured to acquire the rotational speed of the engine 6 from the rotational speed sensor 6*s*. The rotational speed sensor 6*s* is, for example, hardware such as an encoder or a potentiometer connected to a rotational element of the engine 6 (e.g., a crankshaft) or a rotational element of a reduction gear connected to the rotational element. The controller 17 is connected to a temperature sensor 20*s* for detecting the oil temperature of the hydraulic fluid in the oil passage 20 so as to acquire the oil temperature of the hydraulic fluid in the oil passage 20. The controller 17 is connected to a temperature sensor 7*s* for detecting the temperature of the cooling water for cooling the engine 6 so as to obtain the temperature of the cooling water. In FIG. 2, the temperature sensor 7*s* is provided in the heat exchanger 7 for cooling the cooling water, but may be provided in another place.

The controller 17 is an electronic circuit (circuitry) that controls the magnitude of the current flowing to the solenoid 13*s* and controls the rotational speed of the fan 71. This electronic circuit includes a hardware processor 18 and a memory 19, and the control described in the present embodiment may be realized by the hardware processor 18 executing a program stored in the memory 19. This program may be installed in the controller 17 via a computer readable storage medium such as a CD-ROM. Alternatively, the electronic circuit may be an ASIC (Application Specific Integrated Circuit) that performs the controls described in this embodiment.

Figure 3:
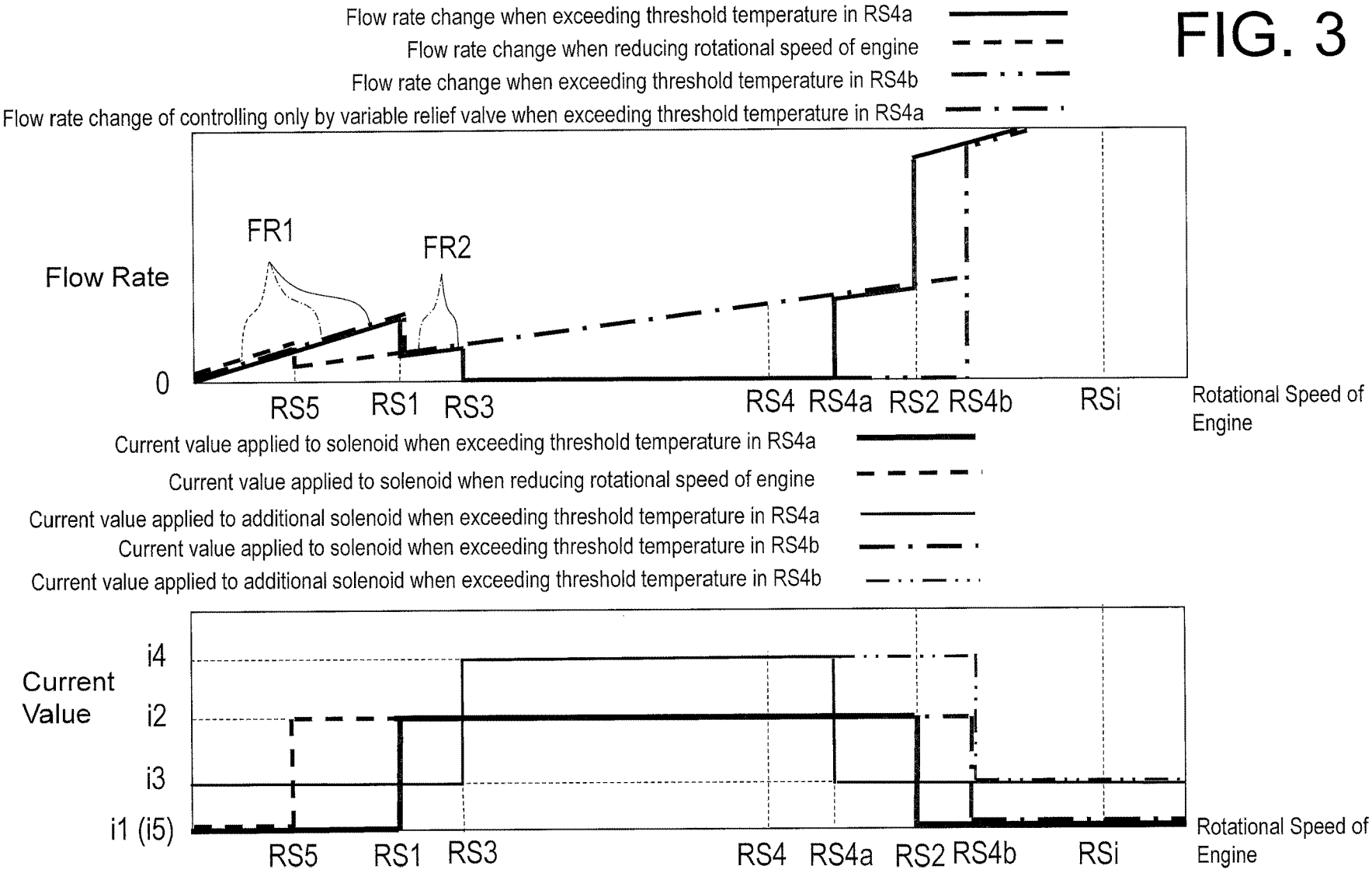
FIG. 3 is a diagram showing the relationship between the rotational speed of the engine, the current flowing through the solenoid, and the flow rate of the hydraulic fluid flowing through the first partial oil passage.

Specifically, with reference to FIG. 3, the controller 17 is configured such that a fan 71 connected to an oil passage 20 (first partial oil passage 21) is rotated by supplying a current (a first current) having a first magnitude i1 to the solenoid 13*s* and flowing a first flow rate of the hydraulic fluid to the oil passage 20 (first partial oil passage 21), when the engine 6 is started. The first magnitude i1 is preferably 0. On the other hand, the controller 17 is configured such that the second bypass oil passage 24 (additional oil passage) is shut off by the unload valve 14 by passing a current (a third current) having a third magnitude i3 through the additional solenoid 14*s* of the unload valve 14 until the rotational speed of the engine 6 exceeds the third rotational speed threshold value RS3 which is not less than the first rotational speed threshold value RS1 from the start of the engine 6. The third magnitude i3 is preferably 0. In FIG. 3, the third magnitude 3 is shown to be larger than the first magnitude i1, but the third magnitude i3 is determined independently of the first magnitude i1. Since the second bypass oil passage 24 is shut off, the first flow rate FR1 is a value obtained by subtracting the flow rate of the hydraulic fluid flowing to the first bypass oil passage 23 through the variable relief valve 13 from the discharge rate of the hydraulic pump 11. Since the discharge amount of the hydraulic pump 11 increases in accordance with the rotational speed of the engine 6, the first flow rate FR1 in accordance with the rotational speed of the engine 6. In FIG. 3, the first flow rate FR1 varies as if it is proportional to the rotational speed of the engine 6, but it is only shown schematically and may vary non-linearly. Except for the case of 0 flow rate, other flow rate changes are the same.

The controller 17 is configured such that the rotational speed of the fan 71 is reduced by passing a current (a second current) having a second magnitude i2 that is larger than the first magnitude i1 to the solenoid 13*s* and supplying a second flow rate FR2 smaller than the first flow rate FR1 of the hydraulic fluid to the oil passage 20 (first partial oil passage 21), when the rotational speed of the engine 6 becomes larger than the first rotational speed threshold value RS1.

On the other hand, when the rotational speed of the engine 6 exceeds a third rotational speed threshold value RS3, the controller 17 is configured to flow the hydraulic fluid from the hydraulic pump 11 to the second bypass oil passage 24 (additional oil passage) through the second bypass oil passage 24 (additional oil passage) by flowing a current (a fourth current) having a fourth magnitude i4 current larger than the third magnitude i3 current to the additional solenoid 14*s* so as to open the unload valve 14. When the unload valve 14 is opened, the hydraulic fluid discharged from the hydraulic pump 11 is released via the second bypass oil passage 24 (additional oil passage) and therefore, the flow rate of the hydraulic fluid flowing into the oil passage 20 (first partial oil passage 21) becomes approximately 0. Preferably, since the first rotational speed threshold value RS1 is equal to the third rotational speed threshold value RS3, the second flow rate FR2 is substantially 0.

The controller 17 is configured such that, when the rotational speed of an engine 6 exceeds a fourth rotational speed threshold value RS4 which is not less than a third rotational speed threshold RS3, the flow rate of a hydraulic fluid flowing through a second bypass oil passage 24 (additional oil passage 20) is changed by supplying an electric current corresponding to the temperature of a liquid flowing inside a work vehicle 1. Specifically, when the rotational speed of the engine 6 is greater than the fourth rotational speed threshold value RS4 and the temperature of the hydraulic fluid exceeds the first threshold temperature T1, the controller 17 is configured so as to close unload valve 14 by supplying a current (a third current) having the third magnitude i3 to the additional solenoid of the unload valve 14. Alternatively, the controller 17 may be configured such that when the rotational speed of the engine 6 is greater than the fourth rotational speed threshold value RS4 and the temperature of the cooling water exceeds the second threshold temperature T2, the third current having the third magnitude i3 is supplied to the additional solenoid 14*s* of the unload valve 14 so as to close the unload valve 14. Preferably, the third rotational speed threshold value RS3 is equal to the fourth rotational speed threshold value RS4.

FIG. 3 shows the current of the additional solenoid 14*s* and the flow rate of the hydraulic fluid flowing to the first partial oil passage 21 when the temperature of the hydraulic fluid exceeds the first threshold temperature T1 at the rotational speed RS4a of the engine 6 which is larger than the fourth rotational speed threshold value RS4 and smaller than the second rotational speed threshold value RS2 by solid lines. In FIG. 3, the electric current of the additional solenoid 14*s* and the flow rate of the hydraulic fluid flowing in the first partial oil passage 21 are shown by a two-dot chain line when the temperature of the hydraulic fluid exceeds the first threshold temperature T1 at the rotational speed RS4b of the engine 6 which is higher than the second rotational speed threshold value RS2. Since all changes are the same until the rotational speed of the engine 6 becomes the rotational speed RS4a, the display of the two-dot chain line is limited to the range where the rotational speed of the engine 6 is the rotational speed RS4a or more. Preferably, the second rotational speed threshold value RS4, which is substantially equal to the target rotational speed of the low idle state of the engine 6, is made smaller than the second rotational speed threshold value RS2 so that the second rotational speed threshold value RS2 can easily reach the target rotational speed of the low idle state of the engine 6.

When the rotational speed of the engine 6 becomes larger than the second rotational speed threshold value RS2 which is not less than the fourth rotational speed threshold value RS4, the controller 17 is configured so as to change the rotational speed of the fan 71 by passing a current corresponding to the temperature of the liquid through the solenoid 13*s*. Specifically, when the rotational speed of the engine 6 is greater than a second rotational speed threshold value RS2 and the temperature of the hydraulic fluid exceeds a first threshold temperature T1, the controller 17 is configured so that a current (a fifth current) having a fifth magnitude i5 equal to or less than the first magnitude i1 is supplied to the solenoid 13*s* of the variable relief valve 13 to close the variable relief valve 13. Alternatively, the controller 17 may be configured so that when the rotational speed of the engine 6 is greater than the second rotational speed threshold value RS2 and the temperature of the cooling water exceeds the second threshold temperature T2, a current having the fifth magnitude i5 is supplied to the solenoid 13*s* of the variable relief valve 13 to close the variable relief valve 13.

In FIG. 3, the current of the solenoid 13*s* is indicated by the solid line when the temperature of the hydraulic fluid exceeds the first threshold temperature T1 at the rotational speed RS4a of the engine 6 which is larger than the fourth rotational speed threshold value RS4 and smaller than the second rotational speed threshold value RS2. In FIG. 3, the current of the solenoid 13*s* is indicated by the one-dot chain line when the temperature of the hydraulic fluid exceeds the first threshold temperature T1 at the rotational speed RS4b of the engine 6 which is higher than the second rotational speed threshold value RS2. Since all changes are the same until the rotational speed of the engine 6 becomes the rotational speed RS4a, the display of the one-dot chain line is limited to the range where the rotational speed of the engine 6 is the rotational speed RS4a or more.

As described above first rotational speed threshold value RS1 to the fourth rotational speed threshold value RS4 are smaller than the idling rotational speed RSi of the engine 6. The idling rotational speed RSi is a minimum rotational speed of the engine 6 which can be set by an accelerator for setting the rotational speed of the engine 6. With the above-described control, when the engine rotational speed exceeds the first rotational speed threshold value RS1, a large flow rate of the hydraulic fluid is not sent to the hydraulic motor 12 until a state in which the viscosity of the hydraulic fluid is considered to be reduced such that the temperature of the hydraulic fluid exceeds a predetermined temperature is reached.

Further, the controller 17 is configured, when the rotational speed of the engine 6 exceeds the first rotational speed threshold value RS1, so as to supply the second current having the second magnitude to the solenoid 13*s* until the rotational speed falls below the fifth rotational speed threshold value RS5 which is smaller than the first rotational speed threshold value RS1 even if the rotational speed falls below the first rotational speed threshold value RS1 again. This fifth rotational speed threshold value. It is considered, for example, as an engine stall when the rotational speed falls below the fifth rotational speed threshold value RS5. Therefore, the fifth rotational speed threshold value RS5 may be the same as a threshold value for determining whether or not the engine is stalled. In FIG. 3, the current value and the flow rate of the hydraulic fluid flowing into the oil passage 20 (the first partial oil passage 21) are indicated by the dotted lines when the current value exceeds the first rotational speed threshold value RS1 and then falls below the first rotational speed threshold value RS1 again. In this case, the current value applied to the additional solenoid 14*s* may be maintained at the fourth magnitude i4 so that the flow rate of the hydraulic fluid flowing to the oil passage 20 (first partial oil passage 21) may be set to 0. As a result, even if the engine load temporarily increases when the rotational speed of the engine 6 exceeds the first rotational speed threshold value RS1, the engine stall can be suppressed. The controller 17 is configured to cause a first current having the first magnitude i1 to flow through the solenoid 13*s* when the rotational speed of the engine 6 exceeds the first rotational speed threshold RS1 and then falls below RS5.

Figure 4:
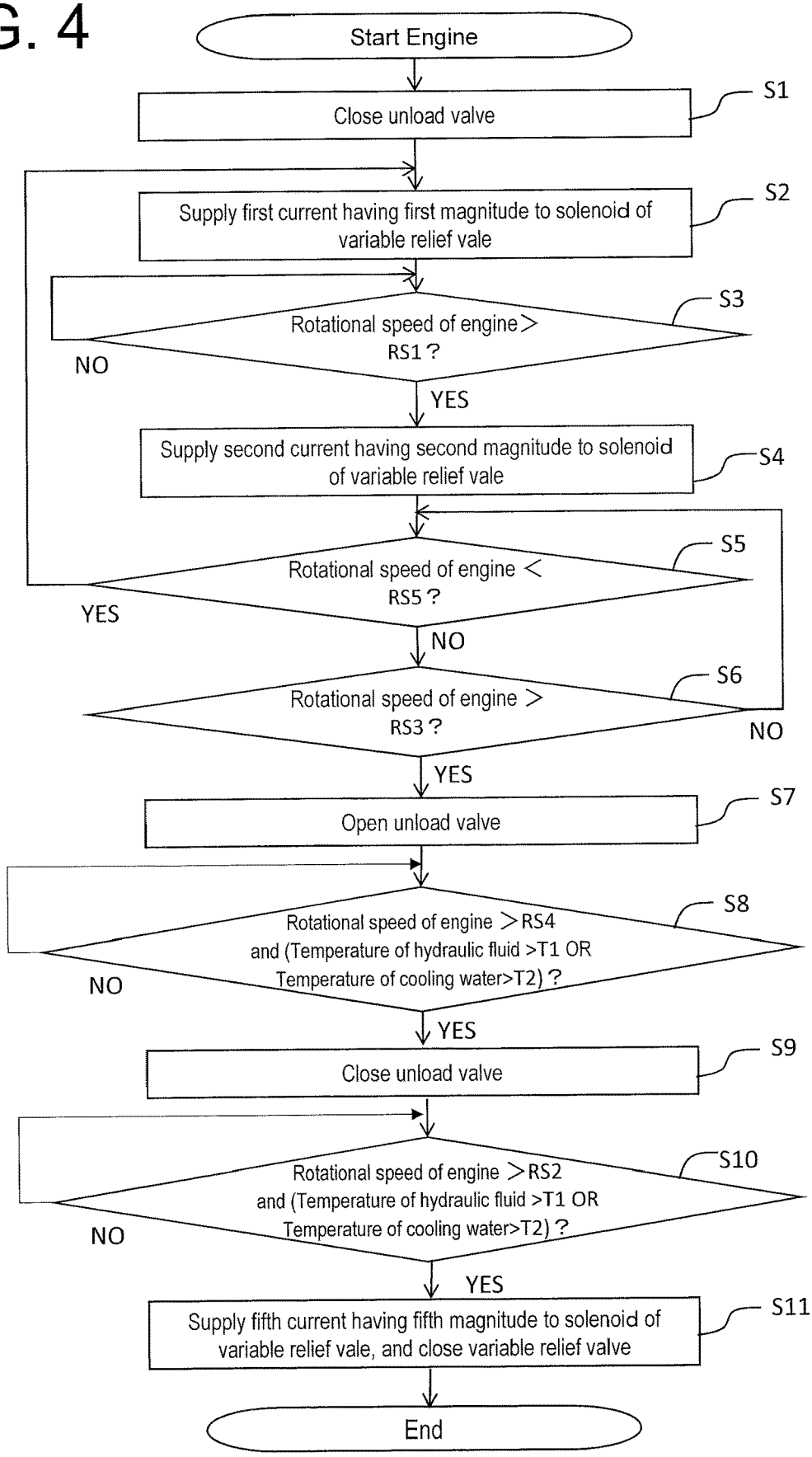
FIG. 4 is a flowchart showing a flow of processing of a control method for a fan of the work vehicle.

FIG. 4 is a flowchart showing a flow of processing of a control method for the fan 71 of the work vehicle 1 according to the present embodiment. In this flowchart, the engine 6 is started when the ignition key of the engine 6 is turned or when the start button of the engine 6 is pressed. In this control method, in step S1, when the engine 6 is started, the controller 17 causes a third current having the third magnitude i3 to flow through the additional solenoid 14*s* of the unload valve 14, thereby blocking the second bypass oil passage 24 (additional oil passage) by the unload valve 14. In step S2, when the engine 6 is started, the controller 17 causes a first current having the first magnitude i1 to flow through the solenoid 13*s* of the variable relief valve 13, thereby causing the hydraulic fluid to flow through the oil passage 20 (first partial oil passage 21) by a first flow rate FR1, and causes the hydraulic motor 12 to rotate, thereby causing the fan 71 to rotate.

In step S3, the controller 17 determines whether the rotational speed of the engine 6 which is obtained from the rotational speed sensor 6*sr* becomes greater than the first rotational speed threshold value RS1. When the rotational speed of the engine 6 is not larger than the first rotational speed threshold value RS1 (NO in step S3), the controller 17 repeats the process of step S3. When the rotational speed of the engine 6 becomes larger than the first rotational speed threshold value RS1 (YES in step S3), in step S4, the controller 17 causes the solenoid 13*s* to flow a second current having the second magnitude i2 larger than the first magnitude i1, thereby causing the hydraulic fluid to flow by a second flow rate FR2 smaller than the first flow rate FR1 into the oil passage 20 (first partial oil passage 21), thereby reducing the rotational speed of the fan 71.

In step S5, the controller 17 determines whether or not the rotational speed of the engine 6 acquired from the rotational speed sensor 6*s* is lower than the fifth rotational speed threshold value RS5. If the rotational speed of the engine 6 is not lower than the fifth rotational speed threshold value RS5 (NO in step S3), the process of step S4 is continued, and then, the process proceeds to step S6. When the rotational speed of the engine 6 is lower than the fifth rotational speed threshold value RS5 (YES in step S3), the controller 17 executes the process of step S2 The processing after step S2 is as shown in the flowchart.

In step S6 The controller 17 determines whether or not the rotational speed of the engine 6 acquired from the rotational speed sensor 6*s* exceeds a third rotational speed threshold value RS3. When the rotational speed of the engine 6 exceeds a third rotational speed threshold value RS3 (YES in step S6), the controller 17 opens the unload valve 14 by passing a current of a fourth size i4 larger than the third size 3 to the additional solenoid 14*s* in step S7, and passes the hydraulic fluid from the hydraulic pump 11 to the second bypass oil passage 24 (additional oil passage 20) through the second bypass oil passage 24 (additional oil passage 20). When the rotational speed of the engine 6 does not exceed the third rotational speed threshold value RS3 (YES in step S6), the process returns to step S5, and the controller 17 executes the process of step S5 again.

In step S8, the controller 17 determines whether or not the rotational speed of the engine 6 acquired from the rotational speed sensor 6*s* exceeds a fourth rotational speed threshold value RS4. When the rotational speed of the engine 6 exceeds a fourth rotational speed threshold value RS4, a current corresponding to the temperature of the liquid (hydraulic fluid, cooling water) is made to flow through an additional solenoid 14*s* to change the flow rate of the hydraulic fluid to be made to flow through a second bypass oil passage 24 (additional oil passage 20). More specifically, in step S8, the controller 17 obtains the oil temperature of the hydraulic fluid in the oil passage 20 from the temperature sensor 20*s* or the temperature of the cooling water from the temperature sensor 7*s*, and it is determined whether or not the temperature of the hydraulic fluid exceeds the first threshold temperature T1. When the temperature of the hydraulic fluid exceeds the first threshold temperature T1 and the rotational speed of the engine 6 exceeds the fourth rotational speed threshold value RS4 (YES in step S8), the controller 17 causes a third current having the third magnitude i3 to flow through the additional solenoid 14*s* of the unload valve 14 to close the unload valve 14 in step S9. When the rotational speed of the engine 6 does not exceed the fourth rotational speed threshold value RS4 or when none of the temperatures determined in step S8 exceeds the threshold value (NO in step S8), the controller 17 repeats the process in step S8.

In step S10, the controller 17 determines whether or not the rotational speed of the engine 6 acquired from the rotational speed sensor 6*s* exceeds the second rotational speed threshold value RS2. When the rotational speed of the engine 6 exceeds the second rotational speed threshold value RS2, a current corresponding to the temperature of the liquid (hydraulic fluid, cooling water) is made to flow through the solenoid 13*s* to change the rotational speed of the fan 71. Specifically, in step S8, the controller 17 further acquires the oil temperature of the hydraulic fluid in the oil passage 20 from the temperature sensor 20*s*, and determines whether the temperature of the hydraulic fluid exceeds the first threshold temperature T1. When the temperature of the hydraulic fluid exceeds the first threshold temperature T1 and the rotational speed of the engine 6 exceeds the second rotational speed threshold value RS2 (YES in step S10), the controller 17 causes the solenoid 13*s* of the variable relief valve 13 to flow the fifth current having the fifth magnitude i5 equal to or smaller than the first magnitude i3 to close the variable relief valve 13 in step S11. When the rotational speed of the engine 6 does not exceed the fourth rotational speed threshold value RS4 or if any of the temperatures determined in step S10 does not exceed the threshold value (NO in step S10), the controller 17 repeats the step S10.

<Effect of the Present Embodiment>

According the embodiments disclosed in the present invention, a work vehicle 1, a control method for a fan 71 of the work vehicle 1, and a controller 17 of the work vehicle 1, and a program incorporated in the controller 17 causes a first current having the first magnitude i1 to flow through the solenoid 13*s* of a variable relief valve 13 when an engine 6 is started, and a second current having the second magnitude i2 larger than the first magnitude (i1) is made to flow through the solenoid 13*s* when the rotational speed of the engine 6 becomes larger than a first rotational speed threshold RS1. When the engine 6 is started, the rotational speed is small, so that the amount of hydraulic fluid discharged from the hydraulic pump 11 is also small. Therefore, even if the flow rate of the hydraulic oil discharged from the variable relief valve 13 to the first bypass oil passage 23 is small, a large amount of the hydraulic fluid with low viscosity is not sent to the hydraulic motor 12. On the other hand, when the rotational speed of the engine 6 becomes larger than the first rotational speed threshold value RS1, the flow rate of the hydraulic fluid discharged from the variable relief valve 13 to the first bypass oil passage 23 is increased, so that even if the discharge rate of the hydraulic fluid from the hydraulic pump 11 increases, a large amount of the hydraulic fluid with low viscosity is not sent to the hydraulic motor 12. Therefore, it is possible to improve power saving by reducing the current supplied to the solenoid 13*s* while reducing the risk that the hydraulic motor 12 is damaged by the hydraulic oil with low viscosity.

Furthermore, a control method for a fan 71 of a work vehicle 1, a controller 17 of the work vehicle 1, and a program incorporated in the controller 17 cause an additional solenoid 14*s* of an unload valve 14 to flow a third current having the third magnitude i3 to shut off a second bypass oil passage 24 by the unload valve 14 when an engine 6 is started, and cause an additional solenoid 14*s* to flow a fourth current having the fourth magnitude i4 larger than the third magnitude i3 to open the unload valve 14 when the rotational speed of the engine 6 exceeds a third rotational speed threshold RS3. When the engine 6 is started, the rotational speed is small, so that the amount of hydraulic fluid discharged from the hydraulic pump 11 is also small. Therefore, even if the hydraulic fluid is not discharged from the unload valve 14 to the second bypass oil passage 24, a large amount of hydraulic fluid with low viscosity is not sent to the hydraulic motor 12. On the other hand, when the rotational speed of the engine 6 becomes larger than the second rotational speed threshold value RS2, since the hydraulic fluid is discharged from the unload valve 14 to the second bypass oil passage 24, the hydraulic fluid with low viscosity is not sent to the hydraulic motor 12 even if the discharge amount of the hydraulic fluid from the hydraulic pump 11 increases. Therefore, it is possible to improve the power saving property by reducing the current supplied to the additional solenoid 14*s* while reducing the risk that the hydraulic motor 12 is damaged by the hydraulic oil with low viscosity.

Furthermore, when the rotational speed of an engine 6 exceeds a fourth rotational speed threshold value RS4, a control method for a fan 71 of a work vehicle 1, a controller 17 of the work vehicle 1, and a program incorporated in the controller 17 cause a current corresponding to the temperature of a liquid (hydraulic fluid, cooling water) to flow through an additional solenoid 14*s* to change the flow rate of the hydraulic fluid to flow through a second bypass oil passage 24. More specifically, when the rotational speed of the engine 6 is greater than the fourth rotational speed threshold value RS4 and the temperature of the hydraulic fluid exceeds the first threshold temperature T1, the additional solenoid 14*s* is supplied with a third current having the third magnitude i3 to close the unload valve 14. When the unload valve 14 is closed, the flow rate of the hydraulic fluid flowing through the oil passage 20 (first partial oil passage 21) increases, but the viscosity of the hydraulic fluid decreases because the temperature of the hydraulic fluid exceeds the first threshold temperature T1. Therefore, the risk of damaging the hydraulic motor 12 can be reduced. Further, when the rotational speed of the engine 6 is greater than the fourth rotational speed threshold value RS4 and the temperature of the cooling water exceeds the second threshold temperature T2, the additional solenoid 14*s* may be supplied with a third current having the third magnitude i3 to close the unload valve 14.

Furthermore, when the rotational speed of the engine 6 exceeds the second rotational speed threshold value RS2, the control method for the fan 71 of the work vehicle 1, the controller 17 of the work vehicle 1, and the program contained in the controller 17 cause a current corresponding to the temperature of the liquid (hydraulic fluid, cooling water) to flow through the solenoid 13*s* to change the rotational speed of the fan 71. Specifically, when the rotational speed of the engine 6 is greater than the second rotational speed threshold value RS2 and the temperature of the hydraulic fluid exceeds the first threshold temperature T1, a fifth current having the fifth magnitude i5 equal to or less than the first magnitude i1 is made to flow through the solenoid 13*s* of the variable relief valve 13 to close the variable relief valve 13. When the variable relief valve 13 is closed, the flow rate (a third flow rate) of the hydraulic fluid flowing through the oil passage 20 (the first partial oil passage 21) increases, but since the temperature of the hydraulic fluid exceeds the first threshold temperature T1, the viscosity of the hydraulic fluid decreases. Therefore, the risk of damaging the hydraulic motor 12 can be reduced. Further, when the rotational speed of the engine 6 is greater than the second rotational speed threshold value RS2 and the temperature of the cooling water exceeds the second threshold temperature T2, the variable relief valve 13 may be closed by passing a fifth current having the fifth magnitude i5 equal to or smaller than the first magnitude i3 through the solenoid 13*s* of the variable relief valve 13.

Further, a control method for the fan 71 of the work vehicle 1, a controller 17 of the work vehicle 1, and a program included in the controller 17 causes when the rotational speed of the engine 6 exceeds the first rotational speed threshold RS1 and then falls below the fifth rotational speed threshold value RS5, the second current having the second magnitude i2 to flow through the solenoid 13*s*, and after the rotational speed of the engine 6 exceeds the first rotational speed threshold RS1 and then falls below the fifth rotational speed threshold value RS5, causes the second current having the second magnitude i2 to flow through the solenoid 13*s*. As a result, even when the rotational speed of the engine 6 is temporarily reduced after the rotational speed of the engine 6 exceeds the first rotational speed threshold value RS1, an increase in load on the engine 6 is suppressed by maintaining the opening degree of the variable relief valve 13. As a result, engine stall can be prevented. When the rotational speed of the engine 6 is lower than the fifth rotational speed threshold value RS5, the engine 6 substantially reaches the engine stall. Therefore, in such a case, power saving can be realized by reducing the current flowing to the solenoid 13*s*.

Modified Examples of the Embodiments

In the embodiment described above, the unload valve 14 and the rotation direction switching valve 15 may be omitted. One of the temperature sensor 7*s* and the temperature sensor 20*s* may be omitted. When the unload valve 14 is omitted, the flow rate of the hydraulic fluid flowing in the oil passage 20 (the first partial oil passage 21) until the rotational speed of the engine 6 becomes the rotational speed RS4a from the first rotational speed threshold value RS1 changes as shown by the one dot chain line in FIG. 3. When the temperature of the hydraulic fluid exceeds the first threshold temperature T1 at the rotational speed of the engine 6 lower than the second rotational speed threshold value RS2, the rotational speed of the engine 6 changes as indicated by a straight line at the second rotational speed threshold value RS2.

FIG. 3 shows a schematic example in which the flow rate of the hydraulic fluid flowing in the oil passage 20 (the first partial oil passage 21) changes linearly, but may change non-linearly.

The processing of step S4 in FIG. 4 may be executed between step S6 and step S7. In this case, if NO in step S4, the process returns to step S1.

As used herein, "comprising" and its derivatives are non-limiting terms that describe the presence of a component, and do not exclude the presence of other components not described. This also applies to "having", "including" and their derivatives.

The terms "member," "part," "element," "body," and "structure" may have multiple meanings, such as a single part or multiple parts.

Ordinal numbers such as "first" and "second" are simply terms used to identify configurations and do not have other meanings (e.g., a particular order). For example, the presence of the "first element" does not imply the presence of the "second element", and the presence of the "second element" does not imply the presence of the "first element".

Terms such as "substantially", "about", and "approximately" indicating degrees can mean reasonable deviations such that the final result is not significantly altered, unless otherwise stated in the embodiments. All numerical values described herein may be interpreted to include words such as "substantially," "about," and "approximately."

In the present application, the phrase "at least one of A and B" should be interpreted to include only A, only B, and both A and B.

In view of the above disclosure, it will be apparent that various changes and modifications of the present invention are possible. Therefore, the present invention may be carried out by a method different from the specific disclosure of the present application without departing from the spirit of the present invention.

What is claimed is:

1. A control method for a fan of a work vehicle, comprising:

supplying, when an engine is started, a first current that has a first magnitude to a solenoid of a variable relief valve connected to an oil passage such that hydraulic fluid output from a hydraulic pump driven by the engine flows through the oil passage by a first flow rate to rotate a hydraulic motor connected to the oil passage;

supplying, when a rotational speed of the engine becomes larger than a first rotational speed threshold value, a second current that has a second magnitude larger than the first magnitude to the solenoid such that the hydraulic fluid flows through the oil passage by a second flow rate smaller than the first flow rate to reduce a rotational speed of the fan;

supplying, when the rotational speed of the engine becomes larger than a second rotational speed threshold value that is larger than the first rotational speed threshold value, a current to the solenoid to change the rotational speed of the fan, the current corresponding to a temperature of liquid flowing in the work vehicle;

supplying, from the start of the engine till when the rotational speed of the engine exceeds a third rotational speed threshold equal to or greater than the first rotational speed threshold value, a third current that has a third magnitude to an additional solenoid of an unload valve provided in parallel with the variable relief valve in an additional oil passage connected in parallel with the oil passage to shut off the additional oil passage by the unload valve;

supplying, when the rotational speed of the engine exceeds the third rotational speed threshold value, a fourth current that has a fourth magnitude larger than the third magnitude to the additional solenoid to open the unload valve such that the hydraulic fluid flows from the hydraulic pump into the additional oil passage; and supplying, when the rotational speed of the engine is equal to or greater than the third rotational speed threshold and exceeds a fourth rotational speed threshold value equal to or less than the second rotational speed threshold value, a current corresponding to the temperature of the liquid through the additional solenoid to change a flow rate of the hydraulic fluid flowing through the additional oil passage.

2. The control method according to claim 1, further comprising:

supplying, when the rotational speed of the engine is greater than the fourth rotational speed threshold value and the temperature of the hydraulic fluid exceeds the first threshold temperature, the third current to the additional solenoid to close the unload valve, wherein the liquid is the hydraulic fluid flowing between the hydraulic pump and the hydraulic motor.

3. The control method according to claim 2, further comprising:

supplying, when the rotational speed of the engine is greater than the second rotational speed threshold value and the temperature of the hydraulic fluid exceeds the first threshold temperature, a fifth current that has a fifth magnitude equal to or smaller than the first magnitude to the solenoid of the variable relief valve to close the variable relief valve.

4. A control method for a fan of a work vehicle, comprising:

supplying, when an engine is started, a first current that has a first magnitude to a solenoid of a variable relief valve connected to an oil passage such that hydraulic fluid output from a hydraulic pump driven by the engine flows through the oil passage by a first flow rate to rotate a hydraulic motor connected to the oil passage;

supplying, when a rotational speed of the engine becomes larger than a first rotational speed threshold value, a second current that has a second magnitude larger than the first magnitude to the solenoid such that the hydraulic fluid flows through the oil passage by a second flow rate smaller than the first flow rate to reduce a rotational speed of the fan;

supplying, when the rotational speed of the engine becomes larger than a second rotational speed threshold value that is larger than the first rotational speed threshold value, a current to the solenoid to change the rotational speed of the fan, the current corresponding to a temperature of liquid flowing in the work vehicle; and supplying the second current to the solenoid until the rotational speed falls below the fifth rotational speed threshold value which is smaller than the first rotational speed threshold value when the rotational speed of the engine exceeds the first rotational speed threshold value.

5. The control method according to claim 4, further comprising:

supplying the first current to the solenoid when the rotational speed falls below the fifth rotational speed threshold value which is smaller than the first rotational speed threshold value after the rotational speed of the engine exceeds the first rotational speed threshold value.

6. A control method for a fan of a work vehicle, comprising:

supplying, when an engine is started, a first current that has a first magnitude to a solenoid of a variable relief valve connected to an oil passage such that hydraulic fluid output from a hydraulic pump driven by the engine flows through the oil passage by a first flow rate to rotate a hydraulic motor connected to the oil passage;

supplying, when a rotational speed of the engine becomes larger than a first rotational speed threshold value, a second current that has a second magnitude larger than the first magnitude to the solenoid such that the hydraulic fluid flows through the oil passage by a second flow rate smaller than the first flow rate to reduce a rotational speed of the fan; and supplying, when the rotational speed of the engine becomes larger than a second rotational speed threshold value that is larger than the first rotational speed threshold value, a current to the solenoid to change the rotational speed of the fan, the current corresponding to a temperature of liquid flowing in the work vehicle, wherein the second rotational speed threshold value is smaller than an idling rotational speed of the engine.

7. A work vehicle comprising:

an engine;

a hydraulic pump to be driven by the engine to supply hydraulic fluid;

an oil passage connected to the hydraulic pump through which the hydraulic fluid flows;

an additional oil passage connected in parallel with the oil passage;

a hydraulic motor provided in the oil passage to be rotated by the hydraulic fluid; and a fan connected to the hydraulic motor to rotate together with the hydraulic motor;

a variable relief valve connected to the oil passage and having a solenoid, the variable relief valve being configured to control a flow rate of the hydraulic fluid flowing through the oil passage in accordance with a current flowing through the solenoid;

an unload valve provided in parallel to the variable relief valve and having an additional solenoid, the unload valve being configured to control a flow rate of the hydraulic fluid flowing through the additional oil passage in response to a current flowing through the additional solenoid; and circuitry configured to control the magnitude of the current flowing through the solenoid to control a rotational speed of the fan, the circuitry being configured to supply, when the engine is started, a first current that has a first magnitude to the solenoid such that the hydraulic fluid flows through the oil passage by a first flow rate to rotate the fan connected to the oil passage, the circuitry being configured to supply, when a rotational speed of the engine becomes larger than a first rotational speed threshold value, a second current that has a second magnitude larger than the first magnitude such that the hydraulic fluid flows through the oil passage by a second flow rate smaller than the first flow rate to reduce the rotational speed of the fan, and the circuitry being configured to supply, when the rotational speed of the engine becomes larger than a second rotational speed threshold value that is larger than the first rotational speed threshold value, a current to the solenoid to change the rotational speed of the fan, the current corresponding to the temperature of the liquid flowing in the work vehicle, wherein the circuitry is configured to supply, from the start of the engine till when the rotational speed of the engine exceeds a third rotational speed threshold equal to or greater than the first rotational speed threshold value, a third current having a third magnitude to the additional solenoid of the unload valve to shut off the additional oil passage by the unload valve, wherein the circuitry is configured to supply, when the rotational speed of the engine exceeds the third rotational speed threshold value, a fourth current that has a fourth magnitude larger than the third magnitude to the additional solenoid to open the unload valve such that the hydraulic fluid flows from the hydraulic pump into the additional oil passage, and wherein the circuitry is configured to supply, when the rotational speed of the engine is equal to or greater than the third rotational speed threshold and exceeds a fourth rotational speed threshold value which is equal to or less than the second rotational speed threshold value, a current corresponding to the temperature of the liquid to the additional solenoid to change the flow rate of the hydraulic fluid flowing through the additional oil passage.

8. The work vehicle according to claim 7, wherein the liquid is a hydraulic fluid flowing between the hydraulic pump and the hydraulic motor, and wherein the circuitry is configured to supply, when the rotational speed of the engine is greater than the fourth rotational speed threshold value and the temperature of the hydraulic fluid exceeds a first threshold temperature, the third current to the additional solenoid to close the unload valve.

9. The work vehicle according to claim 8, wherein the circuitry is configured to supply, when the rotational speed of the engine is greater than the second rotational speed threshold value and the temperature of the hydraulic fluid exceeds the first threshold temperature, a fifth current that has a fifth magnitude equal to or smaller than the first magnitude to the solenoid of the variable relief valve to close the variable relief valve.

10. A work vehicle comprising:

an engine;

a hydraulic pump to be driven by the engine to supply hydraulic fluid;

an oil passage connected to the hydraulic pump through which the hydraulic fluid flows;

a hydraulic motor provided in the oil passage to be rotated by the hydraulic fluid; and a fan connected to the hydraulic motor to rotate together with the hydraulic motor;

a variable relief valve connected to the oil passage and having a solenoid, the variable relief valve being configured to control a flow rate of the hydraulic fluid flowing through the oil passage in accordance with a current flowing through the solenoid; and circuitry configured to control the magnitude of the current flowing through the solenoid to control a rotational speed of the fan, the circuitry being configured to supply, when the engine is started, a first current that has a first magnitude to the solenoid such that the hydraulic fluid flows through the oil passage by a first flow rate to rotate the fan connected to the oil passage, the circuitry being configured to supply, when a rotational speed of the engine becomes larger than a first rotational speed threshold value, a second current that has a second magnitude larger than the first magnitude such that the hydraulic fluid flows through the oil passage by a second flow rate smaller than the first flow rate to reduce the rotational speed of the fan, and the circuitry being configured to supply, when the rotational speed of the engine becomes larger than a second rotational speed threshold value that is larger than the first rotational speed threshold value, a current to the solenoid to change the rotational speed of the fan, the current corresponding to the temperature of the liquid flowing in the work vehicle, wherein, when the rotational speed of the engine exceeds the first rotational speed threshold value, the circuitry is configured to supply the second current to the solenoid until the rotational speed falls below the fifth rotational speed threshold value.

11. The work vehicle according to claim 1, wherein, after the rotational speed of the engine exceeds the first rotational speed threshold value, the circuitry is configured to supply the first current to the solenoid until the rotational speed falls below the fifth rotational speed threshold value which is smaller than the first rotational speed threshold value.

12. A work vehicle comprising:

an engine;

a hydraulic pump to be driven by the engine to supply hydraulic fluid;

an oil passage connected to the hydraulic pump through which the hydraulic fluid flows;

a hydraulic motor provided in the oil passage to be rotated by the hydraulic fluid; and a fan connected to the hydraulic motor to rotate together with the hydraulic motor;

a variable relief valve connected to the oil passage and having a solenoid, the variable relief valve being configured to control a flow rate of the hydraulic fluid flowing through the oil passage in accordance with a current flowing through the solenoid; and circuitry configured to control the magnitude of the current flowing through the solenoid to control a rotational speed of the fan, the circuitry being configured to supply, when the engine is started, a first current that has a first magnitude to the solenoid such that the hydraulic fluid flows through the oil passage by a first flow rate to rotate the fan connected to the oil passage, the circuitry being configured to supply, when a rotational speed of the engine becomes larger than a first rotational speed threshold value, a second current that has a second magnitude larger than the first magnitude such that the hydraulic fluid flows through the oil passage by a second flow rate smaller than the first flow rate to reduce the rotational speed of the fan, and the circuitry being configured to supply, when the rotational speed of the engine becomes larger than a second rotational speed threshold value that is larger than the first rotational speed threshold value, a current to the solenoid to change the rotational speed of the fan, the current corresponding to the temperature of the liquid flowing in the work vehicle, wherein the second rotational speed threshold value is smaller than the idling rotational speed of the engine.

13. A control method for a fan of a work vehicle, comprising:

supplying, when an engine is started, a first current that has a first magnitude to a solenoid of a variable relief valve connected to an oil passage such that hydraulic fluid output from a hydraulic pump driven by the engine flows through the oil passage by a first flow rate to rotate a hydraulic motor connected to the oil passage;

supplying, when a rotational speed of the engine becomes larger than a first rotational speed threshold value, a second current that has a second magnitude larger than the first magnitude to the solenoid such that the hydraulic fluid flows through the oil passage by a second flow rate smaller than the first flow rate to reduce a rotational speed of the fan; and supplying, when the rotational speed of the engine is greater than the second rotational speed threshold value and the temperature of the hydraulic fluid exceeds the first threshold temperature, a fifth current that has a fifth magnitude equal to or smaller than the first magnitude to the solenoid of the variable relief valve to close the variable relief valve such that hydraulic fluid output from the hydraulic pump flows through the oil passage by a third flow rate which is larger than the first flow rate and which increases as the rotational speed of the engine increases.

14. A work vehicle comprising:

an engine;

a hydraulic pump to be driven by the engine to supply hydraulic fluid;

an oil passage connected to the hydraulic pump through which the hydraulic fluid flows;

a hydraulic motor provided in the oil passage to be rotated by the hydraulic fluid; and a fan connected to the hydraulic motor to rotate together with the hydraulic motor;

a variable relief valve connected to the oil passage and having a solenoid, the variable relief valve being configured to control a flow rate of the hydraulic fluid flowing through the oil passage in accordance with a current flowing through the solenoid; and circuitry configured to control the magnitude of the current flowing through the solenoid to control a rotational speed of the fan, the circuitry being configured to supply, when the engine is started, a first current that has a first magnitude to the solenoid such that the hydraulic fluid flows through the oil passage by a first flow rate to rotate the fan connected to the oil passage, the circuitry being configured to supply, when a rotational speed of the engine becomes larger than a first rotational speed threshold value, a second current that has a second magnitude larger than the first magnitude such that the hydraulic fluid flows through the oil passage by a second flow rate smaller than the first flow rate to reduce the rotational speed of the fan, and the circuitry being configured to supply, when the rotational speed of the engine is greater than the second rotational speed threshold value and the temperature of the hydraulic fluid exceeds the first threshold temperature, a fifth current that has a fifth magnitude equal to or smaller than the first magnitude to the solenoid of the variable relief valve to close the variable relief valve such that hydraulic fluid output from the hydraulic pump flows through the oil passage by a third flow rate which is larger than the first flow rate and which increases as the rotational speed of the engine increases.

* * * * *